US008397316B2

(12) United States Patent
Rosen et al.

(10) Patent No.: US 8,397,316 B2
(45) Date of Patent: Mar. 19, 2013

(54) ARTICLE OF PROTECTIVE CLOTHING

(76) Inventors: Wayne R. Rosen, Weston, FL (US); Scott Valency, Weston, FL (US)

( * ) Notice: Subject to any disclaimer, the term of this patent is extended or adjusted under 35 U.S.C. 154(b) by 186 days.

(21) Appl. No.: 12/838,188

(22) Filed: Jul. 16, 2010

(65) Prior Publication Data

US 2011/0010830 A1 Jan. 20, 2011

Related U.S. Application Data

(60) Provisional application No. 61/271,187, filed on Jul. 17, 2009.

(51) Int. Cl.
*A41D 13/00* (2006.01)

(52) U.S. Cl. ..... 2/468; 2/2.5

(58) Field of Classification Search ..... 2/2.5, 468, 2/50, 455, 2.11
See application file for complete search history.

(56) References Cited

U.S. PATENT DOCUMENTS

| | | | | |
|---|---|---|---|---|
| 3,974,313 | A | 8/1976 | James | |
| 4,449,251 | A * | 5/1984 | Gauthier | 2/468 |
| 4,602,385 | A | 7/1986 | Warren | |
| 4,686,710 | A * | 8/1987 | Marston et al. | 2/468 |
| 5,200,263 | A | 4/1993 | Gould et al. | |
| 5,212,837 | A | 5/1993 | Gose et al. | |
| 5,572,740 | A * | 11/1996 | Geniesse | 2/46 |
| 6,044,498 | A | 4/2000 | Schumann et al. | |
| 6,195,802 | B1 | 3/2001 | Armellino | |
| 6,934,968 | B2 * | 8/2005 | Kurpis | 2/49.1 |
| 7,272,861 | B2 | 9/2007 | Colletti et al. | |
| 7,603,724 | B2 | 10/2009 | Mickle | |
| 7,861,326 | B2 * | 1/2011 | Harty | 2/468 |
| 2007/0143908 | A1 * | 6/2007 | Phillips | 2/459 |
| 2010/0122404 | A1 | 5/2010 | Bowlus et al. | |
| 2010/0175430 | A1 | 7/2010 | Garcia et al. | |

FOREIGN PATENT DOCUMENTS

| | | |
|---|---|---|
| CA | 1053402 | 5/1979 |

OTHER PUBLICATIONS

We are Hockey, Itech Ultimate Senior Long Sleeve Loose Fit Shirt (09) Neck Guards Hockey Protective, http://www.purehockey.com/ecom/product/search/3468/Itech-Ultimate-Senior-Long-Sleeve-Loose-Fit-Shirt-%2809%29.html, printed Mar. 15, 2010, 1 page.

* cited by examiner

*Primary Examiner* — Katherine Moran
(74) *Attorney, Agent, or Firm* — McCracken & Frank LLC

(57) ABSTRACT

An article of protective clothing includes a strip of multilayered flexible material adapted to be wrapped entirely around a wearer's neck to form a collar therearound. The multilayered flexible material comprises an interior layer of cut-resistant fabric disposed within a cover of wicking fabric. The strip includes a layer of memory foam attached to a medial portion thereof and an adjustable fastener disposed coextensively over opposite short edges thereof to adjust a diametric size of the collar.

14 Claims, 2 Drawing Sheets

ARTICLE OF PROTECTIVE CLOTHING

CROSS REFERENCE TO RELATED APPLICATIONS

This application claims the benefit of provisional U.S. Patent Application No. 61/271,187, filed Jul. 17, 2009, which is incorporated by reference herein in its entirety.

REFERENCE REGARDING FEDERALLY SPONSORED RESEARCH OR DEVELOPMENT

Not applicable

SEQUENTIAL LISTING

Not applicable

FIELD OF THE INVENTION

The present invention relates to an article of clothing that protects the neck of a wearer from slashing and/or blunt force trauma injuries.

BACKGROUND

Ice hockey players are routinely involved in violent collisions, whether deliberately applied to one another as body checks or as unintended collisions with other players, the boards, or the net. Players often purposely block shots or are inadvertently hit with the puck flying at high speeds. It is during these collisions with players and other objects that hockey players are most vulnerable to injury, especially given that every player skates around the ice on skate blades that can be razor sharp. Getting slashed by another player's skate blade or stick, or hit by a flying puck, especially around the neck area, has proven to be serious and can potentially be deadly. In the past, there have been attempts to provide articles of protective clothing to protect hockey players from the danger of being slashed or hit by a puck around the neck area.

For example, there is a neck protector that is generally formed like a "dickey" and has a tubular section for surrounding the player's neck and a shoulder portion depending from a lower end of the tubular section. The neck protector is formed of a multi-layer stretchable and flexible fabric, wherein one or more inner cut and slash resistant fabric layers are sandwiched between two outer layers made of a wicking fabric. The slash and cut-resistant layers are knitted with a combination of both slash-resistant fibers—such as Kevlar® brand aramid fibers, high density polyethylene fibers, and PBO fibers—and stretchable fibers—such as Lycra® brand spandex fibers. The blend of stretchable and non-stretchable fibers allows the neck protector to fit many different sized wearers. In addition, the neck protector may optionally have an adjustment mechanism, such as a Velcro® brand closure, in order to permit rapid dressing and undressing and adjustment by the wearer. Unfortunately, the neck protector provides little protection against the sort of blunt trauma to a player's neck caused, for example, by a hockey stick, a flying puck, or another player's knee.

Another neck protector has a collar and a bib that depends from a lower portion of the collar. The collar is formed of a sleeve of fabric encasing a removable armored insert that has an armor member coextensive with and attached to a fabric backing. The armor member is formed from a seamless knitted fabric material sold under the trademark WHIZARD®.

The fabric backing is formed from a foam padding laminated on either side of a layer of textile material. The sleeve is wrapped around a wearer's neck and held in place by a Velcro® brand hook and loop fastener. The bib is formed of a 2-ply textile material having a quilted liner therebetween. The seamless knitted fabric material that makes up the armor member can soak up moisture from perspiration and feel heavy around a player's neck. In addition, the moisture can cause the armor member to degrade over time and may be difficult to clean.

A further neck protector includes a neck band assembly that is held within a cover that has a bib downwardly extending therefrom. The cover and the bib are formed from 1000 denier KEVLAR-29® fabric. The cover surrounds the neck band assembly that is formed from shock absorbing unicellular foam material that slowly compresses to absorb applied forces and subsequently recovers to an uncompressed state. A protective outer cover formed alternatively from a jersey type material or KEVLAR-29® fabric encompasses the cover and the bib. The cover includes a Velcro® brand hook and loop fastener that extends from the cover via a tape to hold the cover in place around a wearer's neck. However, when fastened the hook and loop fastener can leave the back of a wearer's neck partially exposed, thereby exposing the wearer's spine to slashing damage and blunt force trauma.

SUMMARY

The inventors have invented a throat protector that in one preferred embodiment may have the attributes of being flexible, comfortable, and attractive to wear, and that also protects a wearer's neck against both slashing injury all the way around a wearer's neck and blunt trauma injury at least at the wearer's trachea. The throat protector may include extension flaps to provide protection to the wearer's upper body and is preferably constructed for easy maintenance and cleaning.

In one aspect of the present invention, an article of protective clothing includes a strip of multilayered flexible material adapted to be wrapped around a wearer's neck to form a collar therearound, and a layer of protective padding attached to the strip and spaced between the short edges so as to be disposed diametrically opposite the adjustable fastener when fastened. The multilayered flexible material includes an interior layer of a flexible cut-resistant fabric disposed within a cover of a wicking fabric, and the strip includes an adjustable fastener at opposite short edges of the strip to adjust a diametric size of the collar;

In another aspect of the present invention, an article of protective clothing includes an elongate strip of multilayered flexible material adapted to be wrapped around a wearer's neck to form a collar therearound. The elongate strip includes a long lower edge extending between opposite ends and comprises a first interior layer of a flexible cut-resistant fabric disposed within a first cover of a wicking fabric. A skirt of multilayered flexible material extends downwardly from the long lower edge of the elongate strip and includes a layer of cut-resistant material. An adjustable fastener is disposed at the short ends for fastening the elongate strip around the wearer's neck.

In a further aspect of the present invention, an article of protective clothing includes a strip of multilayered flexible material having a lower long edge extending between opposite ends and adapted to be wrapped around a wearer's neck to form a collar therearound. The multilayered flexible material includes a layer of a flexible cut-resistant fabric and at least one layer of a wicking fabric. Adjustable cooperating fasteners are disposed at opposite short edges of the strip to adjust a diametric size of the collar, and a layer of padding is coextensively attached to at least one of the adjustable fasteners.

Other aspects and advantages of the present disclosure will become apparent upon consideration of the following detailed description, wherein similar structures have similar reference numbers.

DETAILED DESCRIPTION

Figure 1:
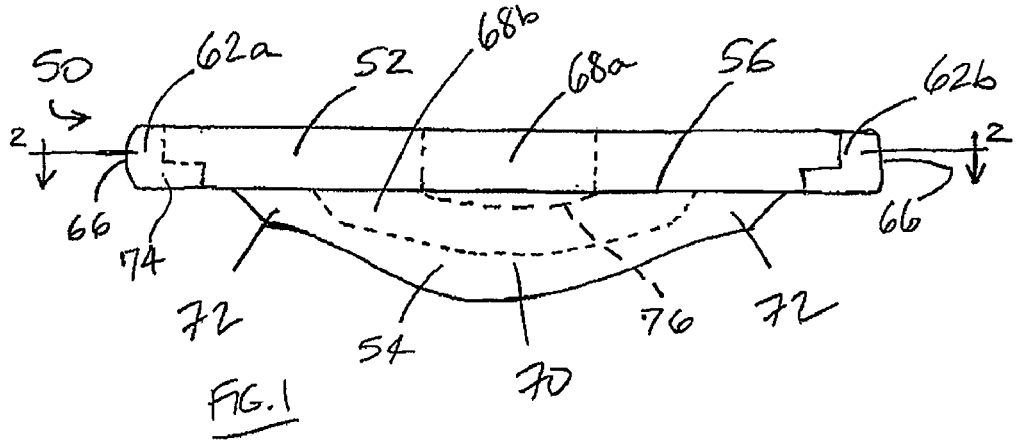
FIG. 1 is a front elevational view of an article of clothing according to the present invention and in an unfastened state.
Figure 2:
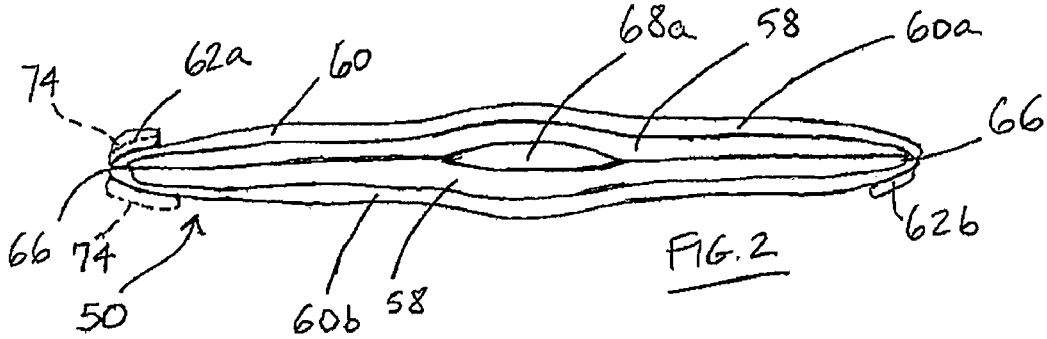
FIG. 2 is a cross sectional view of the article of clothing of FIG. 1, taken generally along the lines 2-2 of FIG. 1 with portions behind the plane of the cross-section omitted for clarity.
Figure 3:
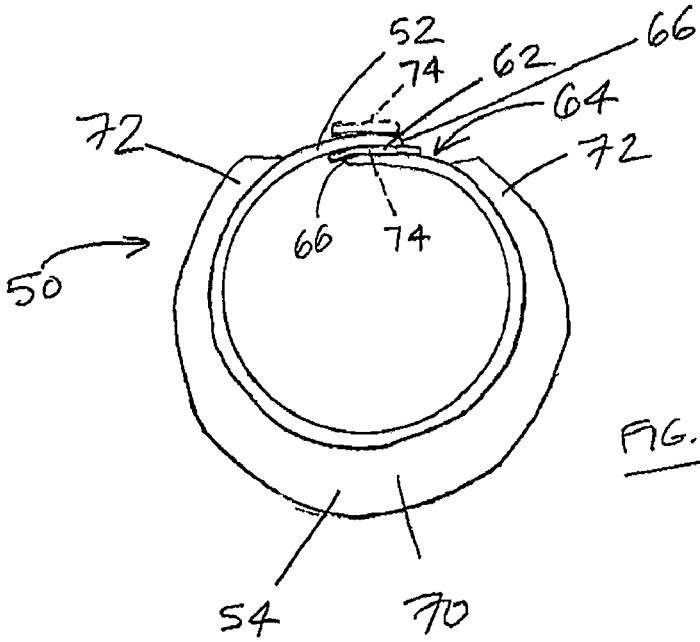
FIG. 3 is a top plan view of the article of clothing of FIG. 1 in a fastened state as adapted to be worn about the neck and shoulders of a user.

Turning now to the drawings, FIGS. 1-3 illustrate a neck protector 50 including a strip 52 that may include an optional downwardly extending bib-like structure, such as a skirt 54, attached to a long edge 56 of the strip 52. The strip 52 and the skirt 54 are made from multilayered flexible material including one or more interior layers 58 of a cut-resistant fabric within a cover 60 of a wicking fabric. An adjustable fastener 62, illustrated as components 62*a* and 62*b* in FIGS. 1 and 2, allows the strip 52 to be formed into a collar 64 of adjustable size. Each of the components 62*a* and 62*b* is attached to the strip 52 proximate opposite short edges 66 of the strip 52. A layer 68*a* of visco-elastic polyurethane foam, commonly called memory foam, is attached to the strip 52, for example, within a medial portion of the strip 52, as illustrated in FIGS. 1 and 2. The layer 68*a* of memory foam held within the strip 52 may extend into the skirt 54, as indicated by the layer 68*b* of memory foam in FIG. 1. In a preferred embodiment, the strip is fastened around and completely surrounds a user's neck with the components 62*a*, 62*b* of the fastener 62 located at the back of the user's neck covering the user's spine, the layer 68*a* of memory foam covering the user's trachea, and the skirt 54, if used, depending downwardly from the long edge 56 of the strip 52 over the user's upper chest and shoulders when the neck protector 50 worn in its preferred position. The strip 52, as shown in FIGS. 1-3, is a generally elongate rectangular shape, having an upper long edge and the lower long edge 56 extending between opposite ends defined by short edges 66, but other shapes of the strip sufficient to cover the wearer's neck as described herein may be used. In the preferred wearing position, the long edge 56 defines a lower edge of the strip 54 and the short edges 66 define opposite longitudinal ends of the strip 52.

In one embodiment, the strip 52 and the skirt 54 may include a single continuous interior layer 58 of a cut-resistant fabric. Alternatively, the skirt 54 and the strip 52 may each include an independent layer or layers 58 of a cut resistant fabric. In one aspect, as illustrated in FIG. 2, the cover 60 may include an inner piece 60*a* attached to an outer piece 60*b* by, for example, stitching around a periphery of the strip 52. Alternatively, the cover 60 including inner and outer pieces 60*a*, 60*b*, may encompass both the strip 52 and the skirt 54 and/or may comprise a unitary piece of material.

The width of the skirt 54 as measured perpendicular from the long edge 56 of the strip 52 varies along the longitudinal length of the strip 52. The skirt 54 includes a medial region 70 disposed longitudinally medially thereon that extends away from the long edge 56 of the strip 52, as illustrated in FIGS. 1 and 3, and is adapted to be disposed below a front of a wearer's neck, for example, covering the wearer's suprasternal notch when the adjustable collar 64 is formed around the wearer's neck. The skirt 54 includes distal regions 72 that extend away from the long edge 56 of the strip 52 and are disposed between the medial region 70 and the short edges 66 of the strip 52. The distal regions 72 are adapted to be disposed over upper portions of the shoulders of the wearer when the adjustable collar 64 is formed around the wearer's neck.

As best seen in FIG. 2, the components 62*a* and 62*b* of the adjustable fastener 62 are each attached coextensively over the opposite short edges 66 of the strip 52, whereby the interior layer of cut-resistant fabric is coextensive with or behind the components 62*a*, 62*b* of the fastener 62. Such coextensive configuration facilitates the attachment of the collar 64 to itself over a wearer's spine without a gap in protection between the opposite short edges 66 of the strip 52, as best seen in FIG. 3. Elimination of such a gap, which could allow impact of a stick, skate blade, or flying puck to lacerate and/or cause blunt trauma to the wearer's spine, provides both complete circumferential protection around the wearer's neck and complete diametric size adjustability of the strip 52. One or both of the components 62*a*, 62*b* may also include a layer 74 of padding covering and/or within the fastener 62. The adjustable fastener 62 preferably includes a hook-and-loop type fastener, wherein for example, the component 62*a* may include a hook-type fastener portion attached over a layer of memory foam or foam rubber and the component 62*b* may include a loop-type fastener portion.

In one embodiment, the strip 52 and the skirt 54 may be formed of two separate pieces and secured together. In such an embodiment, an access port 76, such as a gap, slit-like opening, or notch, may be disposed between the strip 52 and the skirt 54 intermediate the layer 68*a* of memory foam and the medial portion 70 of the skirt. The access port 76 is located intermediate the opposite short edges 66 of the strip 52, and the skirt 54 is connected to the long edge 56 of the strip 52 on opposite ends of the access port near or proximate to the short edges 66. The access port 76 in some embodiments may allow easier flexion and/or turning of the wearer's head and neck. The access port also may provide the benefit of allowing emergency access to areas of a wearer's throat, such as the trachea, by medical personnel, such as may be necessary during an emergency tracheotomy when a player is still in uniform. In one foreseeable circumstance, the foam in layer 68*a* is immediately above and adjacent the access port 76 such that the foam highlights, points to, or otherwise visually accentuates the notch so that the medical personnel can see where the access port 76 is located. In one embodiment, the access port 76 is in the form of a gap between spaced apart edges of the strip 52 and the skirt 54, and in another embodiment, the edges of the strip 52 and the skirt 54 may overlap to provide complete cut-resistant coverage of the underlying body area but not be sewn or connected together at the access port 76 so as to allow emergency access through the neck protector 50.

Figure 4:
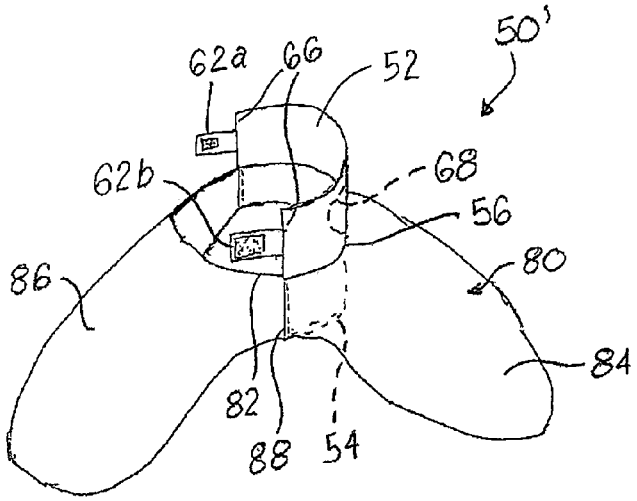
FIG. 4 is a top isometric view of another article of clothing according to the present invention and in an unfastened state.
Figure 5:
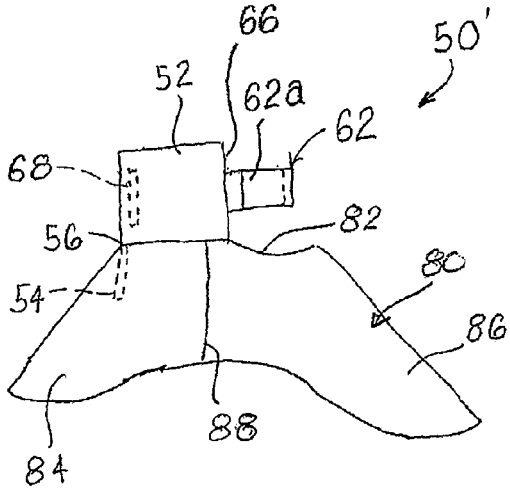
FIG. 5 is front elevational view of an article of clothing of FIG. 4 in an unfastened state.
Figure 6:
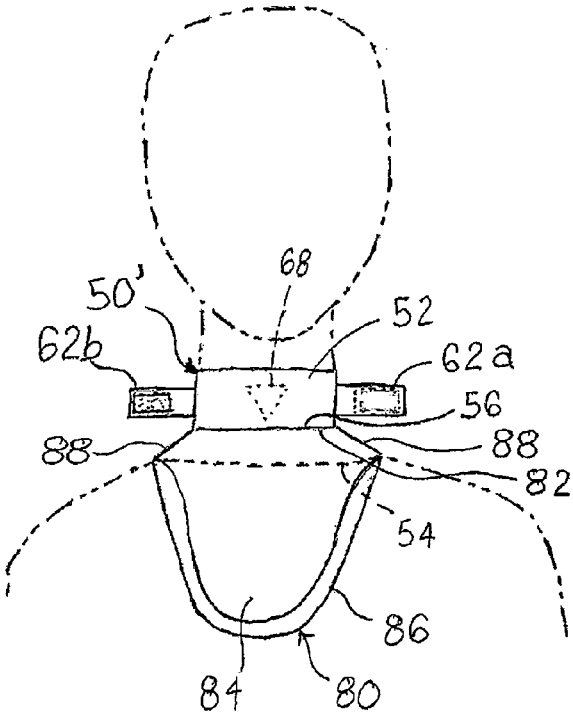
FIG. 6 is a side elevational view of the article of clothing of FIG. 4 in a fastened state and shown in a preferred use placement on a wearer.

In another embodiment, shown in FIGS. 4-6, a neck protector 50' is generally similar to the neck protector 50 and further includes an outer shroud 80 of flexible material shaped to surround the wearer's lower neck and upper shoulders and drape down over the wearer's upper chest and upper back as shown in phantom in FIG. 6. The neck protector includes a strip 52 for extending at least partly around the wearer's neck to form a collar-type structure there around, a skirt 54 extending downwardly from a bottom edge of the strip 52, and a fastener 62 with fastener components 62*a* and 62*b* that extend from opposite longitudinal ends of the strip 52 for fastening the strip 52 around the wearer's neck in a similar manner as described above. In some forms, each of the strip 52, the skirt 54, and the fastener components 62*a*, 62*b* comprises at least a layer of flexible cut-resistant material sandwiched between at least two outer layers of flexible fabric as described previously. The cut-resistant layer preferably is coextensive with the entire area of the each of the strip 52, skirt 54, and fastener components 62*a*, 62*b* in order to provide maximum cut protection. The strip 52 is preferably of a length and width to at least cover the wearer's trachea and major veins and arteries in the neck, as shown in FIG. 5, and may optionally extend all the way around the neck to also cover the wearer's spine. Further, the skirt 54 may have a constant width extending perpendicularly downwardly from the lower edge 56 of the strip 52, as shown in FIGS. 4-6, or the skirt may have a varying width along the length of the strip 52 as shown in FIG. 1.

In this embodiment, each of the fastener components 62*a*, 62*b* is thinner than the strip 54 and includes a cut-resistant layer sandwiched between two outer layers of fabric and a fastener for fastening the fastener components 62*a* and 62*b* together at the back of the wearer's neck. Preferably, the fastener 62 comprises adjustable fasteners, such as complementary hook and loop fastener portions disposed on opposing faces of the fastener components 62*a*, 62*b*. Other fasteners, such as hooks, buttons, laces, snaps, and the like may also or alternatively be used. If the strip 52 extends fully or almost fully around the wearer's neck, the fastener components 62*a*, 62*b* may be very short and/or simply integrated into the ends of the strip 52.

One of the fastener components 62*a* or 62*b* designed to fasten on the exterior side when the fastener components 62*a*, 62*b* overlap, also preferably includes a layer of foamy material disposed between the outer layers of fabric to provide additional protection against blunt trauma.

The strip 52 also includes a protective pad 68, preferably of memory foam or of other stiffer flexible material, disposed at a longitudinal mid-point of the strip 52 for protecting the wearer's trachea as previously described. In this embodiment, the protective pad 68 is permanently embedded between the outer layers of fabric, such as with stitching, and there is no access port between the strip 52 and the skirt 54. As best seen in FIG. 6, the protective pad 68 may have a triangular shape to minimize annoyance to the wearer. Other shapes of the protective pad may also be used, such as rectangular, circular, or an extended longitudinal strip if desired to provide additional protection against blunt trauma to other areas of the wearer's neck. The protective pad 68 need not be secured between the outer layers of fabric, but may be, for example, secured on either exterior side of the strip 52 if desired. Other materials for the protective pad 68 may be used that are stiff or resilient, such as polyvinyl chloride, metal, rubber, and the like, although it is preferred that the material be at least somewhat flexible to minimize annoyance to the wearer.

The shroud 80 has a top edge 82 that is attached to the lower edge 56 of the strip 52 and drapes downwardly therefrom. The shroud 80 includes a front panel 84 and a rear panel 86 that are connected on opposite sides 88 as a unitary piece, and the top edge 82 of the shroud 80 forms a complete circle that can fit around the head and neck of the wearer. The strip 52 is preferably attached only to the top edge 82 of the front panel 84 of the shroud 80, but may also be attached to some or all of the top edge 82 of the rear panel 86 of the shroud 80 if desired. The front panel 84 of the shroud 80 preferably attaches to the lower edge 56 of the strip 52 exteriorly to or atop of the skirt 54 such that the skirt 54 is disposed behind the shroud 80 when the wearer wears the neck protector 50', which conceals the skirt 54 beneath the shroud 80, as best illustrated in FIGS. 4 and 5. The shroud 80 is preferably composed of a wicking fabric similar to that of the cover 60. The shroud 80 may be made of a unitary piece of material or may be made of two or more pieces of material secured to each other by, for example, stitching, Velcro, adhesive, or other attachment mechanism, such as at seams along the sides 88. The width of the shroud 80 (or length as measured perpendicular to the lower edge 56) varies along the length of the strip 52 from in order to be shaped so as to drape lower down over the wearer's upper chest and back and leave open areas at the sides 88. For example, the front and rear portions of the shroud 80 may have a longest width of about ten to fourteen inches, the sides 88 may have a shortest width of about three to five inches, and the width of the shroud 80 may vary smoothly or abruptly between the shortest and longest widths. Of course, other dimensions may be used as necessary for different needs or applications. The top long edge 82 along the rear panel 86 preferably curves downwardly so as to provide additional clearance for the wearer's neck, as best seen in FIG. 5. Preferably, the front panel 84 extends downwardly more than the rear panel 86, and both the front and rear panels 84, 86 extend down far enough to engage underneath other clothing on the wearer's torso, such as a uniform, protective pads, protective vest, shirt, or similar items, which can help maintain the neck guard 50' in a preferred orientation around the wearer's neck. The shroud 80 and other cloth portions of the neck protector 50' is preferably made of a stretchable fabric material, such as elastane, Spandex®, and/or Lycra®, and fabrics blended with such stretchable fabrics or similar materials.

In both neck protectors 50 and 50', any or all of the strip 52, skirt 54 and/or fastener components 62*a*, 62*b* may alternatively include only a single layer of cloth secured to a single layer of cut-resistant fabric, such as by stitching, lamination, adhesive, or other suitable methods. Alternatively, additional layers of cloth and/or cut-resistant fabric and different types of each may be used.

Examples of cut-resistant fabrics include aramid and para-aramid materials that may comprise the layer or layers 58 and include but are not limited to products sold by DuPont under the trademark Kevlar® such as Kevlar® XP™, Kevlar® 129, Kevlar® Comfort XLT™, Kevlar® Correctional™ 779, and Kevlar® KM2®. Additional examples of cut-resistant fabrics may include fabrics having ultra-high molecular weight polyethylene fibers, nylon fibers, and other flexible fibers suitable for forming into a flexible fabric or layer. Examples of wicking fabrics that form the cover 60 include but are not limited to Lycra® Spandex sold by DuPont, nylon, fleece, cotton, and combinations thereof Examples of a hook-and-loop-type fastener attached to a layer of foam rubber include, but are not limited to, Velfoam® loop-type fastener pads sold by Velcro Industries.

Preferably although not necessarily, a team logo or other visual information (not shown) may be located, such as by a sewn or ironed on patch, iron on decal, silk screened ink or paint, embroidery, or other similar known methods, on the outer diameter side of the strip 52 so as to be visible to others when the neck protector is worn by a person in the preferred wearing position around the neck. In some cases, and only by way of non-limiting example, such placement of a team logo may help team members unfamiliar with each other to identify a person as either an opponent or a team member, or placement of a visual cue to the medical personnel pointing out the access port 76. Other varied and beneficial uses of placing such visual information on the outer diameter side of the strip 52 are anticipated and within the scope of this disclosure.

INDUSTRIAL APPLICABILITY

Items of protective clothing are presented that may be used for protection from slashing and/or blunt trauma injury around a wearer's neck as a neck protector. The neck protector in some instances includes a cover of wicking fabric for comfort surrounding internal layers of flexible cut-resistant material, and preferably also includes a protective pad for protection against blunt trauma. The neck protectors may be particularly useful in professions and activities that have an elevated risk of injury to a neck by cutting, slashing, poking, punching, hitting, and other similar methods, such as by hockey players, correctional and police professionals, military personnel, agricultural and construction workers, and any other activity that presents a risk of such neck injuries. Various advantageous features of the items of protective clothing disclosed herein, either individually or in various combinations, may include that the neck protectors may be flexible and light weight, may be easily adjusted to different sizes to provide greater sizing use, can provide protection against both sharp objects and blunt objects, may be easily designed to be attractive to wear, do not impinge on movement of the head and shoulders of the wearer, can integrate with other clothing of the wearer to ensure proper positioning on the wearer's neck and shoulders, and/or provide protection completely around the wearer's neck. Of course, the invention is not limited to any single one or particular combination of such possible advantages and additional advantages may be present also.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive right to all modifications within the scope of the impending claims is expressly reserved.

We claim:

1. An article of protective clothing, comprising:

a strip of multilayered flexible material adapted to be wrapped around a wearer's neck to form a collar therearound, wherein the multilayered flexible material includes an interior layer of a flexible cut-resistant fabric disposed within a cover of a wicking fabric and wherein the strip includes an adjustable fastener at opposite short edges of the strip to adjust a diametric size of the collar and a long lower edge extending between the opposite short edges of the skirt;

a layer of protective padding attached to the strip and spaced between the short edges so as to be disposed diametrically opposite the adjustable fastener when fastened;

a skirt of multilayered flexible material extending downwardly from the long lower edge of the strip; and an access opening disposed between the strip and the skirt, wherein the skirt is connected to the strip on opposite ends of the access opening.

2. The article of protective clothing of claim 1, wherein the protective padding is coextensive with the strip.

3. The article of protective clothing of claim 1, wherein the layer of protective padding comprises memory foam and is disposed within a medial portion of the strip.

4. The article of protective clothing of claim 1, wherein a layer of the skirt comprises a flexible cut-resistant fabric.

5. The article of protective clothing of claim 1, wherein the skirt has a variable width as measured perpendicular from the long edge longitudinally along the strip.

6. The article of protective clothing of claim 1, wherein the protective padding extends from within the medial portion of the strip into the skirt.

7. The article of protective clothing of claim 1, wherein the strip includes two layers of cut resistant fabric.

8. The article of protective clothing of claim 7, further comprising a layer of padding attached to a component of the adjustable fastener and coextensive therewith.

9. The article of protective clothing of claim 8, wherein the adjustable fastener includes a hook-type fastener component and a loop-type fastener component.

10. The article of protective clothing of claim 1, further including a shroud of flexible material attached to the strip that is exterior to and covering the skirt, wherein the shroud circumscribes an opening for a wearer's neck and includes a front portion for covering the wearer's chest, a back portion for covering the wearer's back, and side portions for covering the wearer's shoulders, wherein the front and back portions are longer than the side portions.

11. An article of protective clothing, comprising:

an elongate strip of multilayered flexible material adapted to be wrapped around a wearer's neck to form a collar therearound, wherein the elongate strip comprises a first interior layer of a flexible cut-resistant fabric disposed within a first cover of a wicking fabric, wherein the elongate strip includes a long lower edge extending between opposite ends;

a skirt of multilayered flexible material extending downwardly from the long lower edge of the elongate strip, wherein the skirt includes a layer of cut-resistant material;

an adjustable fastener disposed at the short ends for fastening the elongate strip around the wearer's neck; and a shroud of flexible material attached to the elongate strip that is exterior to and covering the skirt, wherein the shroud circumscribes an opening for a wearer's neck and includes a front portion for covering the wearer's chest, a back portion for covering the wearer's back, and side portions for covering the wearer's shoulders, wherein the front and back portions are longer than the side portions.

12. The article of protective clothing of claim 11, wherein the skirt includes a first region adapted to be disposed below a front of the wearer's neck when the collar is formed therearound and second regions disposed between the first region and the longitudinal ends of the skirt adapted to be disposed over shoulders of the wearer when the collar is formed around the wearer's neck, wherein the second regions are shorter than the first region.

13. The article of protective clothing of claim 12, wherein the skirt has a constant width along the length of the elongate strip.

14. The article of protective clothing of claim 13 further comprising a layer of protective padding attached to the strip and spaced between the short edges so as to be disposed diametrically opposite the adjustable fastener when fastened.

* * * * *